US005585613A

United States Patent [19]

Bell et al.

[11] Patent Number: 5,585,613

[45] Date of Patent: Dec. 17, 1996

[54] POSTAGE METERING APPARATUS INCLUDING MEANS FOR GUARDING AGAINST PRINTING A POSTAGE VALUE WITHOUT ACCOUTING THEREFOR

[75] Inventors: Easton F. Bell, Norwalk; Rein Linask, Monroe; Arno Muller, Westport, all of Conn.; Easwaran C. Nambudiri, Port Chesterl, N.Y.; Peter A. Pagliaro, West Haven, Conn.; Sandra J. Peterson, Norwalk, Conn.; Neeraj Sen, Fairfield, Conn.; Christopher D. Smith, New Milford, Conn.

[73] Assignee: Pitney Bowes Inc., Stamford, Conn.

[21] Appl. No.: 562,531

[22] Filed: Nov. 24, 1995

[51] Int. Cl.[6] ..... G07G 1/00

[52] U.S. Cl. ..... 235/101; 364/464.02

[58] Field of Search ..... 235/101; 364/464.02

[56] References Cited

U.S. PATENT DOCUMENTS

| | | | |
|---|---|---|---|
| 4,253,015 | 2/1981 | McFiggans et al. | 235/92 FP |
| 4,980,542 | 12/1990 | Jackson et al. | 364/464.02 |
| 5,058,025 | 10/1991 | Haines et al. | 364/464.02 |
| 5,307,280 | 4/1994 | Haug | 364/464.02 |

FOREIGN PATENT DOCUMENTS

| | | | |
|---|---|---|---|
| 0388840 | 9/1990 | European Pat. Off. | G07B 17/04 |
| 0388841 | 10/1994 | European Pat. Off. | G07B 17/00 |
| 0388843 | 11/1994 | European Pat. Off. | G07B 17/04 |

*Primary Examiner*—Patrick J. Stanzione

*Attorney, Agent, or Firm*—Angelo N. Chaclas; Charles G. Parks, Jr.; Melvin J. Scolnick

[57] ABSTRACT

In postage metering apparatus having printing structure, structure for selecting respective postage values to be printed, structure for requesting printing selected postage values, structure for accounting for each postage value requested to be printed, and structure for controlling operation of the printing structure, an improvement for preventing printing a postage value without accounting therefor, the improvement comprising: the requested postage values including respective zero postage values; the controlling structure including structure for counting each request for printing a zero postage value; and the controlling structure including structure for preventing operation of the printing structure in response to the counting structure counting a predetermined number of the zero postage values.

10 Claims, 3 Drawing Sheets

POSTAGE METERING APPARATUS INCLUDING MEANS FOR GUARDING AGAINST PRINTING A POSTAGE VALUE WITHOUT ACCOUTING THEREFOR

BACKGROUND OF THE INVENTION

This invention is generally concerned with postage metering apparatus including means for guarding against printing a postage value without accounting therefor, and more particularly with postage metering apparatus including means for disabling an operation thereof upon accounting for a predetermined number of zero postage value requests.

In the course of conducting a search concerning the subject matter of the present invention, the following references were found: U.S. Pat. No. 3,702,097 for Anti-Hammer Apparatus For Powered Imprinters, issued Nov. 7, 1972 to St. Jean; U.S. Pat. No. 4,253,015 for an Electronic Postage Meter Having An Accounting System Independent Of Power Failure, issued Feb. 24, 1981 to Eckert et al.; and, U.S. Pat. No. 5,307,280 for a Franking Machine, issued Apr. 26, 1994 to Haug.

Of the aforesaid references the '015 Patent, issued to Eckert et al., is relevant in that it describes conventional electronic postage metering apparatus, comprising, a rotary printing drum having mounted therein a plurality of print wheels, structure for feeding a sheet to the drum, structure for selectively rotating the print wheels to a postage value to be printed on a sheet fed to the drum, and prior art structure for causing the postage value to be accounted for before being printed. For accounting purposes, the postage metering apparatus includes a microprocessor having structure which is programmed for accounting for the selected postage value and thereafter releasing an interposer, which is normally disposed in blocking relationship with the printing drum, to permit a single revolution of the drum for printing the selected postage value.

In addition, the '280 Patent issued to Haug is relevant in that it describes a franking machine which includes a casing and a main memory for storing a total postage value available for printing, and includes prior art structure for guarding against tampering with the total postage value when the casing is open. To that end, the franking machine includes a central processing unit (CPU) having a service program which is implemented when the casing is opened for transferring the total postage value from a main memory to an inaccessible backup memory, thereby changing the stored value in the main memory to a zero value. Although not a model of clarity, a fair reading of the '280 Patent indicates that while the casing is open, the program causes polling to occur, for periodically sequentially checking the postage value stored in the main memory and the settings of the print wheels, to respectively determine whether the memory has stored therein more than a zero value and whether the print wheel settings are set to more than a zero value, and, if either of such events occur, the program causes such values to be changed to zero values. Accordingly, while the casing is open, the program remedies tampering with the main memory and the print wheel settings to thereby prevent the subsequent printing of an unaccounted for postage value. On the other hand, when the casing is thereafter closed, although the program causes the total postage value to be restored to the main memory, no program processing occurs to either thwart, guard against or remedy the printing of any unaccounted for postage value.

Thus, the references are silent concerning the provision of structure for disabling an operation or preventing any particular use of postage metering apparatus, for example, of the type described in the '015 Patent issued to Eckert et al, which has been purposely physically damaged to immobilize the print wheels so that with each revolution of the printing drum a non-zero postage value is printed, although the microprocessor controlled accounting structure accounts for the selection of a zero postage value to be printed and releases the interposer to permit a single revolution of the damaged drum.

Moreover, the references are silent concerning the provision of structure for preventing a User of postage metering apparatus who processes a batch of letters, from improperly using the postage metering apparatus for printing zero postage values on a small percentage, say up to 15%, of the batch of letters, with the thought in mind of taking a chance that Postal Service employees who spot check batches of letters will not discover the inclusion of numerous letters having printed thereon a zero postage value.

Accordingly, an object of the invention is to provide postage metering apparatus including means for guarding against printing a postage value without accounting therefor; and another object is to provide postage metering apparatus including means for disabling an operation or preventing a use thereof upon accounting for a predetermined number of requests for printing a zero postage value,

SUMMARY OF THE INVENTION

In postage metering apparatus having printing means, means for selecting respective postage values to be printed, means for requesting printing selected postage values, means for accounting for each postage value requested to be printed, and means for controlling operation of the printing means, an improvement for preventing printing a postage value without accounting therefor, the improvement comprising: the requested postage values including respective zero postage values; the controlling means including means for counting each request for printing a zero postage value; the controlling means including means for preventing operation of the printing means in response to the counting means counting a predetermined number of the zero postage values.

BRIEF DESCRIPTION OF THE DRAWINGS

As shown in the Drawings, wherein like reference numerals designate like or corresponding pads throughout the several views.

DESCRIPTION OF THE PREFERRED EMBODIMENTS

Figure 1:
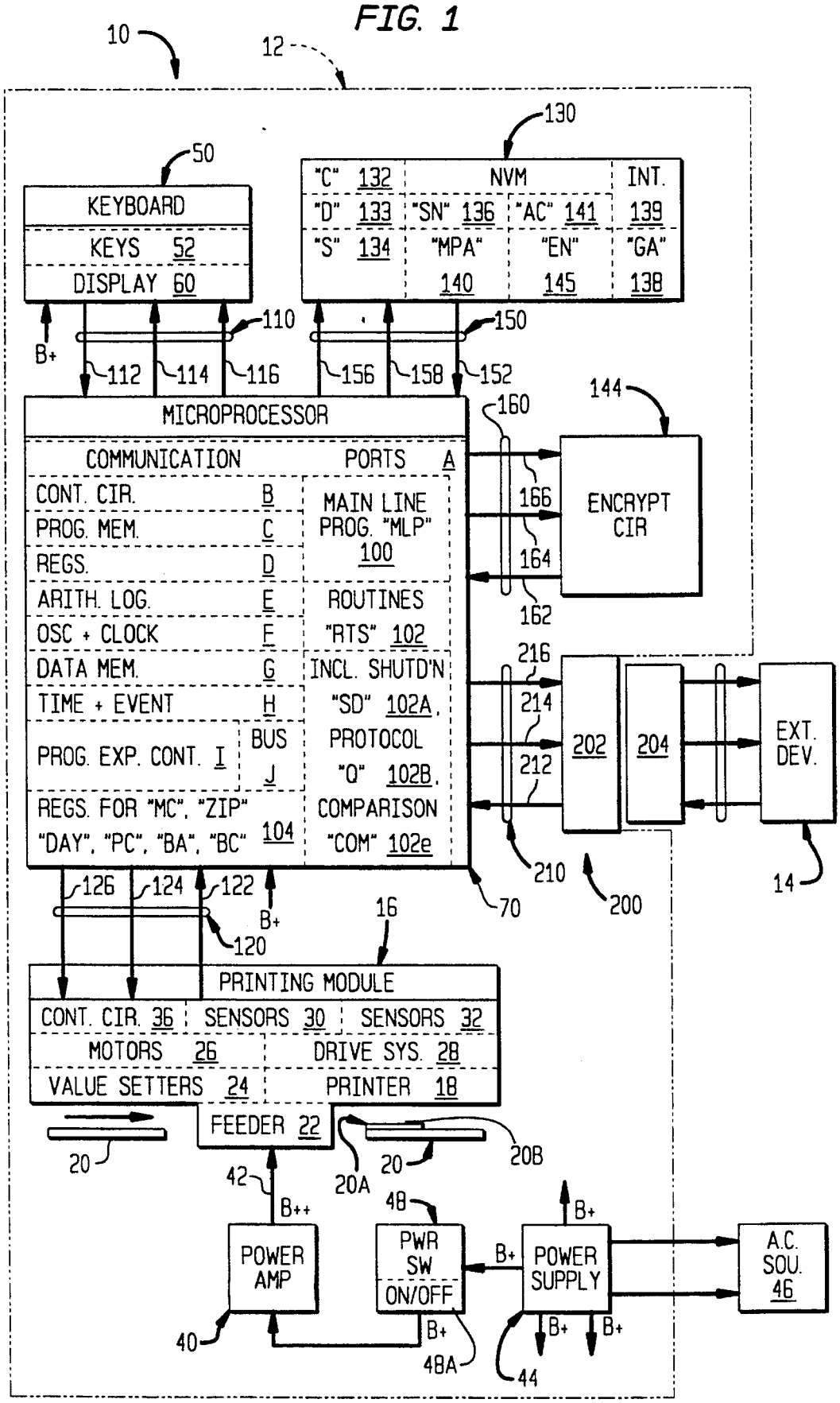
FIG. 1 is schematic block diagram of conventional postage metering apparatus including structure according to the invention for guarding against printing a postage value without accounting therefor.

As shown in FIG. 1 the postage metering apparatus 10 according to the invention comprises a conventional postage meter 12 which is suitably adapted to be connected to an external device 14. The postage meter 12 may be used in any application wherein it is desirable to meter a postage, shipping, taxation, food stamp or other monetary amount, in human or machine readable form, or as an encrypted version thereof. Thus although the postage meter 12 is described herein for use in the preferred embodiment, as a device for metering a postage or shipping value and printing that value alone or in combination with other alphanumeric or graphic information on a stuffed envelope or on a label which is suitable for affixation to an article to be mailed or shipped, the term "postage value" is intended to connote any monetary value and the term "postage metering" is intended to mean the metering of any monetary value.

The postage meter 12 (FIG. 1) includes a suitable printing module 16. The printing module 16 includes printing structure 18 such as any conventional impact, rotary, thermal, ink jet, laser or other commercially available printing structure 18 to which sheets 20, such as labels, stuffed envelopes or other sheets, may be fed for printing thereon a postage indicia 20A, including an increment of postage value 20B. The printing module 16 additionally includes sheet feeding structure 22, which may be any conventional roller or vacuum type structure for engaging and feeding the sheets 20 to the printing structure 18, and feeding sheets 20 therefrom and thus from the postage meter 12. Moreover, the printing module 16 includes postage value setting structures 24 for setting the postage value 20B which is to be printed by the printing structure 18. Further, the printing module 16 includes one or more motors 26, and includes one or more drive systems 28 connected between the respective motors 24 and the printing, feeding and value setting structures 18, 22 and 24. The printing module 16 may also include a plurality of conventional sensors 30 for sensing various positions of respective sheets 20. The printing module 16 may further include a plurality of sensors 32 for sensing respective positions of selected components of the printing, feeding and value setting structures, 18, 22 and 24, and of the motors and drive systems, 26 and 28. And, the printing module 16 may include a conventional control circuit 36 which is connected to a microprocessor 70, as hereinafter described, and is conventionally constructed and arranged for communicating input signals thereto from the sensors, 30 and 32, and communicating control signals therefrom to the motors 26 for operation of the drive systems 28, and thus for operation of the printing, feeding and value setting structures, 18, 22 and 24, under the control of the microprocessor 70 for processing requests for printing postage values.

For energizing the printing module 16 (FIG. 1), the postage meter 12 includes a conventional power amplifier 40. The power amplifier 40 is suitably electrically connected to the printing module 16, by means of a high power lead 42 (B++). In addition, for providing power to the postage meter 12, and thus to the power amplifier 40, the postage meter 12 includes a conventional d.c. power supply 44 which is suitably adapted to be removably connected to an external A.C. source 46. Preferably, to avoid inadvertent energization of the printing module 16, the postage meter 12 includes a conventional, manually actuatable, on-off switch 48, having a switch actuation member 48A, which is suitably electrically connected between the power supply 44 and power amplifier 40. As thus constructed and arranged, all of the components of the apparatus 10 other than the printing module 16 are continuously energized for operation thereof when the power supply 44, and thus the postage meter 12, is connected to the external A.C. source 46; whereas assuming connection to the A.C. source 46, the printing module 16 is operable when the switch actuation member 48A is in the "on" position, and is inoperable when the switch actuation member 48A is in the "off" position.

The postage meter 12 (FIG. 1) additionally includes a keyboard 50, having a plurality of manually actuatable keys 52 (FIG. 2) and a display 60. The keys 52 preferably include a plurality of individually manually actuatable numerical value input keys 53, including the ten keys 53 which are marked with the numerals zero(0) through nine(9) inclusive and one key 53 labeled with a decimal point(.). In addition, the keys 53 include a clear key 54 labeled "C". The keys 53 are selectively sequentially depressible for selecting and displaying a postage value to be entered. Further, the keys 52 preferably include a value setting key 55 labeled "S", which is depressible for entering a selectively displayed postage value as the postage value requested to be printed. Moreover, the keys 52 preferably include an arithmetic logic key 56 labeled plus "+" and minus "–", which is selectively depressible for adding, and thus including therein, a predetermined value, such as a special delivery cost, to a previously selectively displayed postage value prior to entry thereof, and thus before actuation of the value setting key "S" 55. And, the keys 52 preferably include a plurality of display keys 57. The display keys 57 are respectively provided with labels well known in the art for identifying values stored in the postage meter 12, such as "postage used", "postage unused", "control sum", "piece count", "batch", and "batch count" values. And, the display keys 57 are selectively depressible for causing the respective values referred to by the labels be selectively shown in the display 60. Without departing from the spirit and scope of the invention, the display 60 may be any commercially available display for providing the User of the postage meter 12 with at least visual information corresponding to respectively selected display keys 57 and to the selected keys 52 of the keyboard 50, and thus the postage value 20B including added costs, if any, which has been selected for printing.

For controlling operation thereof, the postage meter 12 (FIG. 1) includes a conventional microprocessor 70 which may be any commercially available microprocessor having a sufficient number of communication ports "A", including interrupts, available for communicating with the components of the postage meter 12 and with any external device 14 which is connectable to the postage meter 12. Moreover, of such ports "A", a sufficient number thereof should be available or be programmable for serial or parallel communications, as the case may be, to provide for a separate two-way serial or parallel communications link for each of the internal components of the postage meter 12 and any external device 14 which are to be connected for two-way communication with the microprocessor or controller 70. Of course, the microprocessor 70 may include a plurality thereof to provide for additional communication ports "A" and other added capacities which are called for in the particular application. Accordingly, the following general discussion concerning the microprocessor 70 applies to each of the microprocessors or controllers used in a particular application.

The microprocessor 70 (FIG. 1) generally comprises conventional structure including a plurality of control circuits "B", a program memory circuit "C", a plurality of working and spare register circuits "D", an arithmetic logic unit "E", one or more oscillator and clock circuits "F", data memory circuits "G" timer and event counter circuits "H", a program expansion control circuit "I" which are respectively to an internal communication line bus "J".

In addition, the microprocessor 70 includes conventional structure 100 for storing a main line program "MLP", accessible via the communications bus "J", for controlling operation of the postage meter 12, including operation thereof in response to requests for printing postage values which are entered via the keyboard 50 or via the interface structure 200 hereinafter discussed. In this connection it is noted that main line program "MLP" generally includes conventional processes for accounting for each requested postage values. And, according to the invention, the program "MLP" also includes a process for storing data corresponding to a count of zero postage value requests, comparing that count to a predetermined maximum count "MC" thereof, of at least one, and implementing the shutdown routine "SD" hereinafter discussed if the count of zero postage requests is equal to the maximum count "MC" thereof. Further, the main line program "MLP" generally includes conventional processes for clearing respective conditions of disablement of respective operations of the postage metering apparatus 10. And, according to the invention, the program "MLP" also includes a process for clearing the count of zero postage value requests and enabling operation of the postage metering apparatus 10 for the purpose of processing postage value requests, in response to the microprocessor 70 receiving a predetermined request or command. Moreover, the microprocessor 70 includes conventional structure 102 for storing therein a plurality of subsidiary routines "RTS", of the main line program "MLP", for processing other data stored in the postage metering apparatus 10. In this connection, it is noted that the microprocessor 70 preferably includes a plurality of register circuits 104 for storing therein data corresponding to the predetermined maximum count "MC" of zero postage value requests, the ZIP Code "ZIP" identifying the geographic location of the postage meter 12, the current date "DAY", and the current piece count "PC", batch "BA" and batch count "BC" values corresponding to one or more batches of sheets 20 which are currently being processed by the postage metering apparatus 10. Further, according to the invention, the microprocessor structure 102 for storing subroutines "RTS" includes a portion 102A thereof for storing a conventional shutdown routine "SD". The shutdown routine "SD" is conventionally constructed and arranged for operation under the control of the main line program "MLP" for disabling one or more operations of the postage meter 12, including, for example, the operation thereof of processing postage value printing requests, in response to the occurrence of one or more operational events known in the art as critical faults 10. In this connection it is noted that, according to the invention, the shutdown routine "SD" is operable under the control of the main line program "MLP" for disabling operation of the postage meter 12 from processing postage value printing requests, in response to a count of such requests, which have a zero postage value, being equal to the predetermined maximum count "MC". Moreover, the microprocessor structure 102 for storing the subroutines "RTS" includes a portion 102B thereof for storing a conventional handshake protocol "Q". The handshake protocol "Q" is preferably constructed and arranged to utilize the access code "AC", either alone or in combination with the serial number "SN" of the postage meter 12, for establishing communications between the postage meter 12 and an external device 14. Moreover, the structure 102 for storing subroutines "RTS", includes a portion 102C thereof for storing a conventional comparison routine "COM", for comparing an authorized manufacturer's password "MPA" with passwords of potential User's of the postage meter 12, and, assuming a favorable comparison, for enabling operation of the postage metering apparatus 10 for any and all purposes.

The keyboard 50 (FIG. 1) is conventionally electrically connected to the microprocessor 70, as by means of a serial communications link 110 for providing thereto data signals, including but not limited to those corresponding to respective requests for printing selected postage values, an receiving therefrom other data signals. To that end, the link 110 includes a data input lead 112 for providing data signals to the microprocessor 70, a data output lead 114, for receiving data signals from the microprocessor 70, and a clock lead 116, for receiving clock signals from the microprocessor 70. Moreover, the printing module 16 is suitably electrically connected, via the control circuit 36 thereof, to the microprocessor 70 for operation under the control of the microprocessor 70, as by means of another serial communications link 120. The link includes a data input lead 122, for providing data signals to the microprocessor 70, a data output lead 124, for receiving data signals from the microprocessor, and a clock lead 126 for receiving clock signals from the microprocessor 70.

Figure 2:
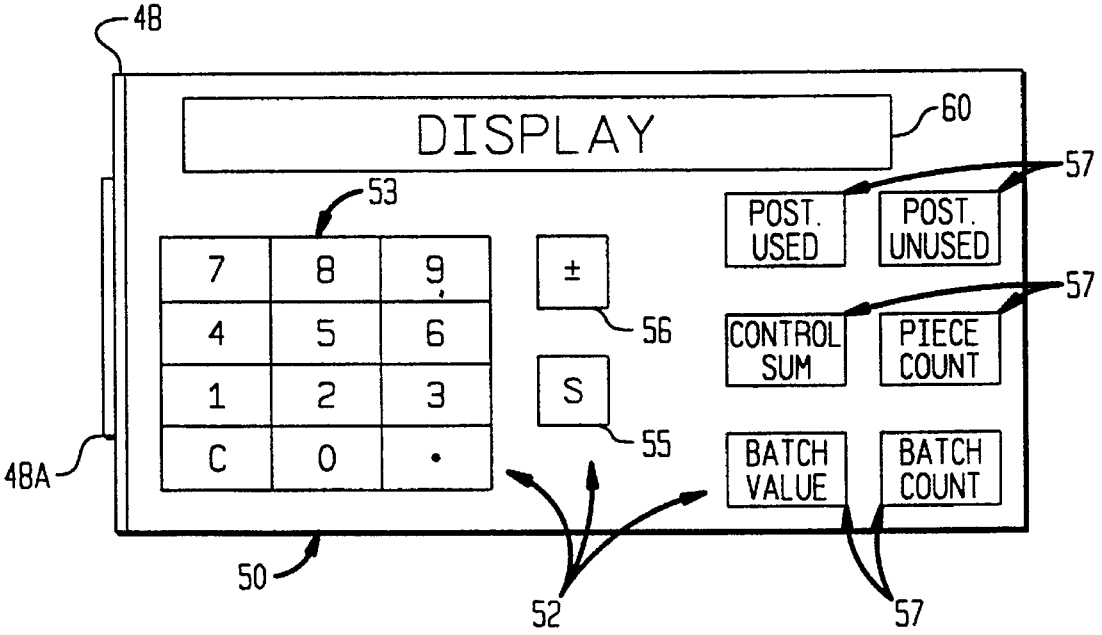
FIG. 2 is a schematic block diagram of the keyboard and power switch of the postage metering apparatus of FIG. 1.

The postage meter 12 (FIG. 1) also preferably includes a suitable nonvolatile memory (NVM) 130. The NVM 130 preferably includes conventional structures 132 and 133 for respectively storing a total credit or postage unused value "C", corresponding to the total postage currently available for printing, and storing a total debit or postage used value "D", corresponding to the total of all postage value increments 20B which have ever been entered, and thus ever have been made available to the printing module 16 for printing by the postage meter 12 during the life of the postage meter 12. In addition, the NVM 130 preferably includes conventional structures 134 and 137 for respectively storing a control sum "S", corresponding to the sum of the aforesaid current total credit value "C" and current total debit value "D", and storing the serial number "SN" of the postage meter 12. Further, depending on the type of printing structure 18 utilized in the postage meter 12, the NVM 130 may include conventional structure 138 for storing data corresponding to a graphic image "GI" of a postage indicia 20A, including, for example, an Eagle, alone or in combination with other information, such as a conventional State and Town circle, and postage box, together with the name of the State and Town wherein the postage meter 12 is located. Moreover, the NVM 130 preferably includes conventional structure, such as a suitable interface circuit 139, which is conventionally operable under the control of the microprocessor 70 for decrementing the currently available total credit value "C" and incrementing the current total debit value "D", by an amount which is equal to the current increment of value 20B which is to be printed by the printing module 16, in response to each actuation of the value setting key 55 (FIG. 2).

Further, according to the invention, the NVM 130 (FIG. 1) preferably includes conventional structures 140 and 141, for respectively storing therein a password "MPA" and access code "AC" which are predetermined by the manufacturer of the postage meter 12 for use by authorized personnel of the manufacturer, such as sales and maintenance personnel. The password "MPA" is provided to permit such personnel to operate the postage meter 12 for any and all purposes, whereas the access code "AC" is provided for use by such personnel in the course of establishing communications between the postage meter 12 and an external device 14.

Since the security of a postage meter is of such great importance, the postage meter 12 (FIG. 1) may also include a suitable encryption circuit 144, which is conventionally operable under the control of the microprocessor 70 for encrypting various numerical values to provide for secure communication and printing thereof. The encryption circuit 144 comprises conventional structure for encrypting one or more of the numerical values stored in the NVM 130 and microprocessor 70, including, for example, the total credit value "C", the total debit value "D" and the control sum "S", the Zip Code "ZIP" corresponding to the geographic location of the postage meter 12, the Serial Number "SN" of the postage meter 12, and one or more other selected values, such as the graphic image "GI" and current date "DAY", and the current "piece count", "batch" and "batch count" values. Moreover, assuming the provision of the encryption circuit 144, the NVM 130 preferably includes conventional structure 145 for storing therein suitable data corresponding to one or more encryption keys "EN".

The microprocessor 70 (FIG. 1) is conventionally electrically connected to the non-volatile memory (NVM) 130 via a communication link, such as address, data and control leads connected to the communications line bus "J", or a serial or parallel communication link, represented by the communications link 150. Thus the link 150 may include data input lead 152, for providing data signals to the microprocessor 70, and data output and clock leads, 156 and 158, for respectively receiving data and clock signals from the microprocessor 70. In addition, the microprocessor 70 is preferably similarly suitably electrically connected to the encryption circuit 144 as by means of a communications link 160. Thus the link 160 may includes a data input lead 162, for providing data signals to the microprocessor 70, and data output and clock leads, 164 and 166, for respectively receiving data and clock signals from the microprocessor 70.

In addition, according to the invention, for communicating with respective external communication devices 14, for example, for receiving therefrom data signals corresponding to respective requests for printing respective postage values, the postage meter 12 preferably includes conventional interface structure 200, such as a receptacle 202 for receiving a communications line plug 204 of an external device 14. In addition, the microprocessor 70 is preferably electrically connected to the interface structure 200 as by means of a serial communications link 210. The link 210 includes a data input lead 212, for providing data signals to the microprocessor 70, a data output lead 214, for providing data signals to the interface structure 200 and a clock lead 216 for providing clock signals to the interface structure 200.

Figure 3:
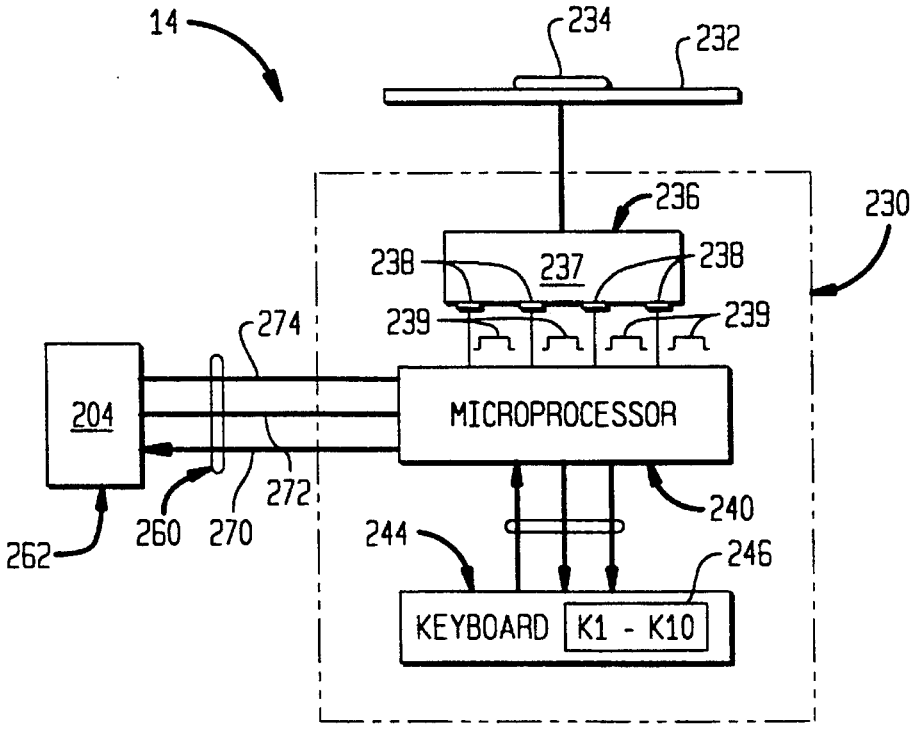
FIG. 3 is a schematic block diagram of an external device to which the postage metering apparatus of FIG. 1 may be connected.

As shown in FIG. 3, an external device 14 to which the postage meter 12 (FIG. 1) may be removably connected includes a conventional electronic scale 230 (FIG. 3). The scale 230 includes a platform 232 on which an article 234 to be weighed is placed. In addition, the scale 230 preferably includes conventional weigh responsive structure 236, such as a conventional load cell 237 having a plurality of sensors 238 suitably connected thereto for generating electrical signals, such as the signals 239, corresponding to the weight of an article 234 placed on the platform 232. The scale 230 also includes a conventional microprocessor 240, to which the weighing structure 236 is suitably electrically connected for receiving the signals 239 corresponding to the weight of the article 234. Moreover, the scale 230 includes a conventional keyboard 244 which is suitably electrically connected to the microprocessor 240 and has a plurality of keys 246, such as the ten keys 246 labeled K1–K10 inclusive. The keys 246 are manually actuatable for providing input signals to the microprocessor 240 corresponding to conventional mailing or shipping information, such as the destination Zip Code, physical dimensions or class of delivery service of the article 234. In addition, the microprocessor 240 is conventionally programmed for providing data signals to the postage meter 12 (FIG. 1) which correspond to respective requests for printing postage or shipping values derived from the input signals 239 received from the weighing structure 236 (FIG. 3) and the keyboard 244. To that end, the scale 230 includes a conventional serial communications link 260, having conventional interface structure 262, such as the plug 204, which is removably connectable to the postage meter's interface structure 200 as hereinbefore discussed. The link 260 includes a data output lead 270, for providing data signals to the interface structure 260, a data input lead 272, for providing data signals to the scale 230, and a clock lead 274, for providing clock signals to the scale 250.

Figure 4:
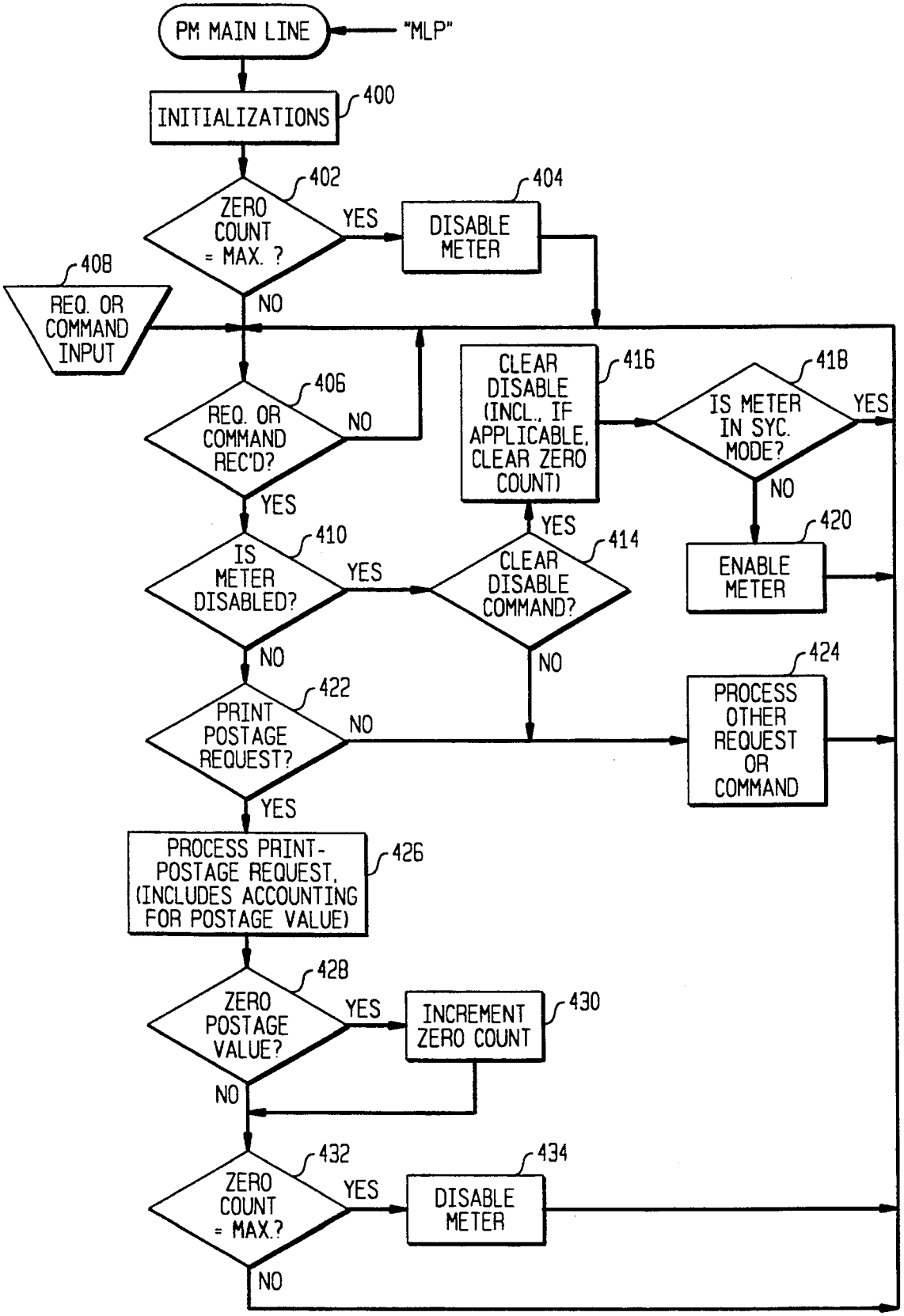
FIG. 4 is flow chart showing the steps of a process according to the invention for guarding against printing a postage value without accounting therefor.

Assuming energization of the postage metering apparatus 10 (FIG. 1), the main line program "MLP" initially causes the microprocessor 70 to execute the step 400 (FIG. 4) of initializing the microprocessor ports "A" and the components connected thereto, including the printing module 16, keyboard 50, NVM 130 and encryption circuit 144, and the external device 14, if any. Thereafter, the program "MLP" causes the microprocessor 70 to implement the step 402 of determining whether a count of the number of postage printing requests which have been made for a zero postage value is equal to a predetermined maximum count of at least one. Assuming the count of zero-postage-value requests is not equal to the maximum count, step 402, the program "MLP" causes the microprocessor 70 directly to implement the step 406 of inquiring whether the postage metering apparatus 10 has received a request or command, and, assuming that it has not, to then continuously loop through step 406 until a request or command 408 is received.

On the other hand, if the count of zero-postage-value requests is equal to the maximum count, step 402 (FIG. 4), then, the program "MLP" initially causes the microprocessor 70 to execute the step 404 of calling up and executing the shutdown routine "SD" for disabling operation of the postage 12, and thus the postage metering apparatus 10, from processing requests for printing postage values, thereby preventing the printing module 16 from printing postage values 20B. Thereafter, the program "MLP" causes the microprocessor to implement the step 406 of inquiring whether the postage metering apparatus 10 has received a request or command, and, assuming that it has not, to then continuously loop through step 406 until a request or command 408 is received.

Thus, after energization thereof, whether or not the postage metering apparatus 10 (FIG. 1) is disabled from processing postage requests, further operation of the postage metering apparatus 10 is contingent upon receiving a request or command via the keyboard 50 or interface structure 200. Before discussing such operation it is noted that, assuming disablement of operation of the postage metering apparatus 10, according to the invention any one or more of a plurality of optional remedies may be required to be initiated by the User of the postage metering apparatus 10 for the purpose of curing the disablement condition and returning the apparatus 10 to service. For example, the User may be obliged to transport the postage metering apparatus 10 to an authorized facility for servicing the apparatus 10, including but not limited to a Postal Services' or Postage Meter Manufacturer's facility, where a representative of the servicing facility inspects the postage metering apparatus 10, prepares a report concerning the disablement condition thereof, and enters there into a request or command, including but not limited to a code, for clearing the disablement condition and enabling operation thereof. Or, the User may be obliged to communicate with, as via a telephone line, an authorized servicing facility, including but not limited to a Postal Services' or Postage Meter Manufacturer's Data Center or other centralized postage accounting facility, to file therewith a report concerning the disablement condition of the postage metering apparatus 10 and to obtain therefrom a request or command, including but not limited to a code, for entry into the postage metering apparatus 10 to clear the disablement condition and enable operation thereof. Or, the User may be obliged to communicate with, as via a telephone line, an authorized servicing facility of the type noted above, to call in an authorized service person (a) to inspect the postage metering apparatus 10, file a report concerning the disablement condition thereof and enter there into a request or command, including but not limited to a code, to clear the disablement condition and enable operation thereof, or (b) to communicate with, as via a telephone line, an authorized servicing facility of the type noted above, to file therewith a report concerning the disablement condition of the postage metering apparatus 10 and enter there into a request or command to clear the disablement condition and enable operation thereof. With the above thoughts in mind it is noted that each of the above discussed remedies for returning the postage metering apparatus 10 to service calls for the entry into the postage metering apparatus 10 of a request or command.

Referring again to FIG. 4 and assuming processing to be in the course of continuously looping through step 406, upon receiving a request or command 408, the main line program "MLP" then causes the microprocessor 70 to implement the step 410 of determining whether the postage metering apparatus 10 is disabled. Assuming at this juncture that the postage metering apparatus 10 is not disabled, the program "MLP" then causes the microprocessor 70 to implement the step 422 of determining whether the request or command is a request to print postage, step 422. Assuming the request or command is not a request to print postage, step 422, then, the program "MLP" causes the microprocessor 70 to execute the step 424 of conventionally processing the request or command, followed by returning processing to step 406 to await the next request of command 408. On the other hand, assuming the request or command is a request to print postage, step 422, then, the program "MLP" causes the microprocessor 70 to execute the step 426 of processing the postage request, including the step accounting for the requested postage value, followed by the step 428 of determining whether the requested postage value was a zero postage value. Assuming the requested postage value was not a zero postage value, step 428, then, the program "MLP" causes the microprocessor 70 to directly implement the step 432 of determining whether the count of zero-postage-value requests is equal to the aforesaid predetermined maximum count. However, if the requested postage value was a zero amount, step 428, then, the program "MLP" causes the microprocessor 70 initially to implement the step 430 of incrementing the count of zero-postage-value requests and then to implement the step 432 of determining whether the count of zero-postage-value requests is equal to the aforesaid predetermined maximum count. Thus step 432 includes the step of comparing the count of zero-postage-value requests and the predetermined maximum count. Thereafter, if the count of zero-postage-value requests does not compare, that is, is less than equal, to the aforesaid predetermined maximum count, then, the program "MLP" causes the microprocessor 70 to return processing to step 406 to await the next request or command 408. On the other hand, if the count of zero-postage-value requests does compare, that is, is greater than or equal to, to the aforesaid predetermined maximum count, then, the program "MLP" causes the microprocessor 70 initially to implement the shutdown routine "SD" for disabling the postage metering apparatus 10 from processing postage requests, followed by returning processing to step 406 to await the next request or command 408.

Referring back to step 410, and assuming the postage metering apparatus 10 is disabled, then, the program "MLP" causes the microprocessor to implement the step 414 of determining whether the request or command is a clear-disable command. Assuming the request or command is not a clear-disable command, step 414, the program "MLP" causes the microprocessor 70 to implement the step 424 of conventionally processing the request or command and then returning processing to step 406. On the other hand, if the request or command is a clear-disable command, then, the program "MLP" causes the microprocessor 70 to implement the step 416 of clearing the relevant disablement condition of the postage metering apparatus 10. Assuming that the disablement was due to the count of zero-postage-value requests having been equal to the maximum count, then implementation of step 416 comprises clearing the count of zero-postage-value requests. Thereafter, the program "MLP" causes the microprocessor to implement the step 418 of determining whether the postage metering apparatus 10 is in the service mode of operation. Assuming that the apparatus 10 is in the service mode of operation, step 418, then, the program "MLP" causes processing to be returned to step 406 to await the next request or command, including, for example, a command causing the apparatus 10 to exit the service mode of operation. If however the apparatus 10 is not in the service mode of operation, step 418, then, the program "MLP" causes the microprocessor 70 initially to enable operation of the postage metering apparatus 10 before returning processing to step 406 to await the next request or command 408.

What is claimed is:

1. In postage metering apparatus having printing means, means for selecting respective postage values to be printed, means for requesting printing selected postage values, means for accounting for each postage value requested to be printed, and means for controlling operation of the printing means, an improvement for preventing printing a postage value without accounting therefor, the improvement comprising:

(a) the requested postage values including respective zero postage values;

(b) the controlling means including means for counting each request for printing a zero postage value; and (c) the controlling means including means for preventing operation of the printing means in response to the counting means counting a predetermined number of the zero postage values.

2. The apparatus according to claim 1, wherein the predetermined number is at least one.

3. The apparatus according to claim 1, wherein the controlling means includes means for storing a predetermined count corresponding to the predetermined number of zero postage values, the counting means storing a current count of requests for printing zero postage values, and the controlling means including means for comparing the current and predetermined counts.

4. The apparatus according to claim 3 including means for clearing the current count in response to input data received when operation of the printing means is prevented.

5. The apparatus according to claim 3 including a service mode of operation, and including means for enabling operation of the printing means in response to input data received when the apparatus is not in the service mode of operation.

6. Postage metering apparatus comprising:

(a) means for printing;

(b) means for selecting respective postage values to be printed;

(c) means for respectively requesting printing the selected postage values;

(d) means for controlling a plurality of operations of the apparatus, controlling means including means for storing a predetermined maximum count of at least one, the controlling means including means for accounting for each postage value requested to be printed, the controlling means including means for storing a current count of requested zero postage values, the controlling means including means for comparing the current and maximum counts, and the controlling means including means for disabling a predetermined operation of the apparatus if the counts compare.

7. The apparatus according to claim 6, wherein the plurality of operations of the apparatus includes an operation thereof for processing requests for printing respective postage values, and said predetermined operation includes said operation for processing printing requests.

8. The apparatus according to claim 6, wherein the controlling means includes means for clearing said current count in response to receiving input data for causing said clearing when the operation of the apparatus is disabled.

9. The apparatus according to claim 6 including a service mode of operation thereof, and the controlling means includes means for enabling said predetermined operation of the apparatus in response to receiving input data for causing said enabling when said predetermined operation is disabled and the apparatus is not in the service mode of operation.

10. The apparatus according to claim 6, wherein said maximum count is greater than one, and the controlling means includes means for incrementing the current count after the accounting means accounts for a zero postage value to be printed.

* * * * *